United States Patent [19]

Switzgable

[11] Patent Number: 4,548,015

[45] Date of Patent: Oct. 22, 1985

[54] THERMALLY BROKEN INSULATION SUPPORT STRUCTURE

[76] Inventor: Harold Switzgable, 5 Lyndon La. South, Box 171, Monmouth Junction, N.J. 08852

[21] Appl. No.: 516,617

[22] Filed: Jul. 25, 1983

[51] Int. Cl.[4] ..... E04C 3/30

[52] U.S. Cl. ..... 52/729; 52/731; 49/DIG. 1

[58] Field of Search ..... 52/247, 410, 579, 580, 52/588, 594, 595, 714, 715, 802, 803, 804, 805, 729, 730, 731, 732, 220, 221, 98, 478, 480; 49/501, DIG. 1

[56] References Cited

U.S. PATENT DOCUMENTS

| | | | |
|---|---|---|---|
| 1,842,144 | 1/1932 | Bohnsak | 52/714 |
| 2,027,870 | 1/1936 | Larson | 52/220 |
| 2,720,289 | 10/1955 | Henrickson | 52/478 |
| 3,014,560 | 12/1961 | Krauss et al. | 52/397 |
| 3,035,669 | 5/1962 | Graff | 52/730 |
| 3,156,332 | 11/1964 | Cameron | 52/403 |
| 3,218,771 | 11/1965 | Horn | 52/98 |
| 3,335,524 | 8/1967 | Carson | 49/501 |
| 3,353,318 | 11/1967 | Bacher | 52/403 |
| 3,557,507 | 1/1971 | Wilder | 52/404 |
| 3,828,514 | 8/1974 | Jureit | 52/714 |
| 4,020,611 | 5/1977 | Amos | 52/584 |
| 4,053,972 | 10/1977 | Kordes | 52/309.11 |
| 4,114,341 | 9/1978 | Vincens | 52/580 |
| 4,192,119 | 3/1980 | Murphy | 52/588 |
| 4,236,366 | 12/1980 | Rijnders | 52/580 |
| 4,267,679 | 5/1981 | Thompson | 52/403 |
| 4,299,070 | 11/1981 | Oltmanns et al. | 52/309.11 |

FOREIGN PATENT DOCUMENTS

| | | | |
|---|---|---|---|
| 16958 | 10/1980 | European Pat. Off. | 52/730 |

*Primary Examiner*—John E. Murtagh
*Assistant Examiner*—Andrew Joseph Rudy
*Attorney, Agent, or Firm*—Sperry, Zoda & Kane

[57] ABSTRACT

A support structure for providing a building panel or an insulation support panel over the exterior or interior surfaces of pre-existing walls which includes a thermal insulation member for isolating the outer building panel from the inner building panel. This support structure is particularly usable with insulation which is in preformed blocks such as polystyrene rather than insulation which is blown in like polyurethane. A positively engaging mechanical lock mounts the inner support structure with respect to the outer support structure that maintains a complete thermal isolation therebetween. The interlocking device includes two clips adapted to be positively secured to opposite ends of the thermal brake member wherein each of the clips is adapted to be fixedly but detachably secured with respect to the inner and outer wall support structure.

14 Claims, 4 Drawing Figures

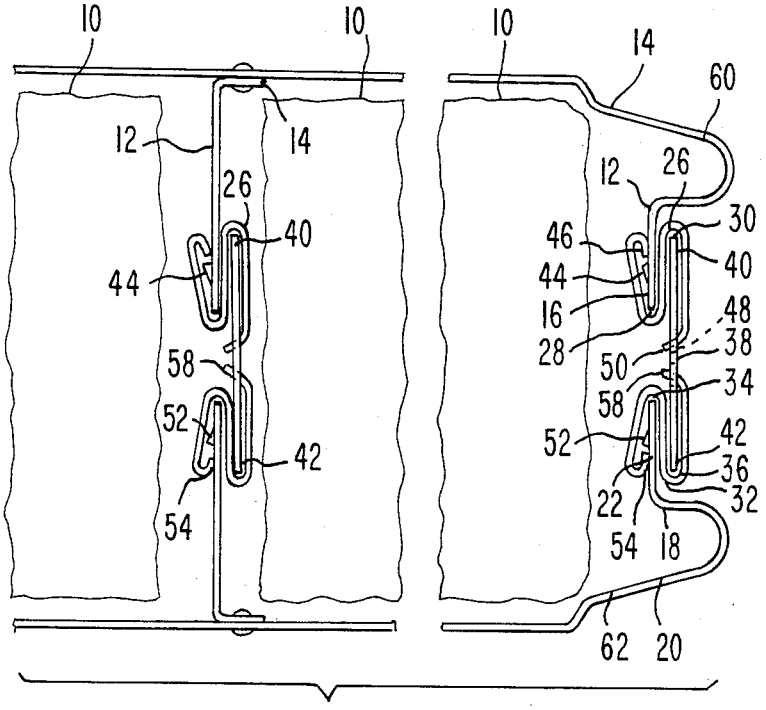
Fig. 2
Fig. 4
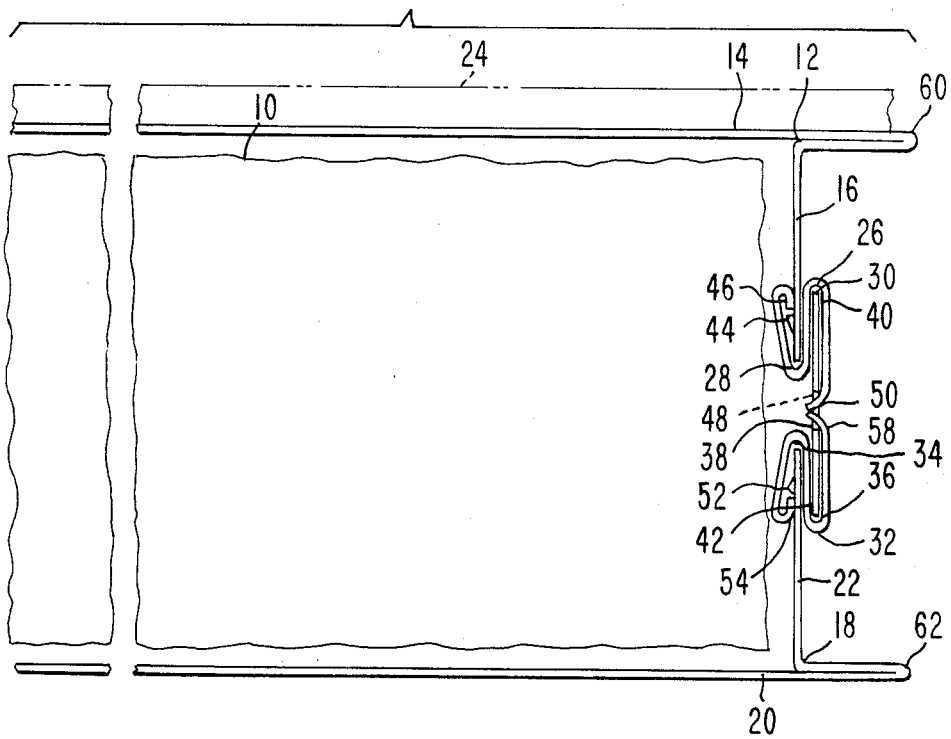

THERMALLY BROKEN INSULATION SUPPORT STRUCTURE

BACKGROUND OF THE INVENTION

1. Field Of The Invention

The present invention deals with the field of building support structures and in particular building or wall panels which are normally of some depth in order to allow insulation to be placed therein. The present invention provides such a building panel which can be used itself or in addition to a normal pre-existing wall structure. In this manner the present invention can provide a wall configuration itself or can provide an inner or outer facing for providing insulation across a pre-existing wall configuration.

This invention deals with the field of devices for providing thermal isolation between an inner and outer wall structure even around the periphery thereof to facilitate effective insulation.

2. Description Of The Prior Art

A number of building panels have been designed for providing insulation such as those shown in the following U.S. Pat. Nos.: 3,014,560 issued to W. W. Krauss et al on a Building Panel; 3,156,332 issued to D. J. Cameron on an Insulated Metal Structure; 3,335,524 to L. F. Carson on a Thermal Break Door; 3,353,318 to L. O. Bacher on an Insulated Joint For Panel Walls; 3,557,507 to A. M. Wilder on a Fabricated Wall; 4,020,611 to A. C. Amos on a Wall Assembly; 4,053,972 to M. G. Kordes on a Method Of Constructing Insulated Door; 4,236,366 to W. Rijnders on a Prefabricated Wall Panel; 4,267,679 to L. Thompson on an Insulated Building Panel Wall Construction; and 4,299,070 to H. Oltmanns et al on a Box Formed Building Panel Of Extruded Plastic.

These patents show various types of interlocking configurations between panels for supporting wall structures which may or may not include insulation therebetween but none show the positive and yet detachable locking configuration utilizing clips as shown in the present invention.

SUMMARY OF THE INVENTION

The present invention provides a thermally broken insulation support structure which is usable with a great variety of different types of insulation is specifically usable with blocks of polystyrene insulation material. This support structure includes a first support member which includes a first facing member and a first mounting arm. The first mounting arm extends outwardly from the support member approximately perpendicular with respect thereto. The mounting arm extends toward the interior of the structure and the first support member extends parallel to a wall structure to which the support structure is to be mounted such that it provides a facing. A second support member is included having a second facing member and a second mounting arm extending perpendicularly outward therefrom toward the first mounting arm and being spatially disposed with respect thereto. This first facing member and the second facing member are spatially separated and approximately parallel with respect to one another.

A first clip means which may be S-shaped is included which defines a first outward gripping slot therein to grip and hold the outwardly extending end of the first mounting arm. The first clip means also includes a first inward gripping slot therein which is adapted to grip the thermal insulation member.

A second clip means which may also be S-shaped is positioned defining a second outwardly facing gripping slot therein to grip and hold the outwardly extending end of the second mounting arm. The second clip means further includes a second inwardly gripping slot therein to grip the opposite end of the thermal isolation member.

This thermal isolation member is preferably of a rigid thermally insulated material which includes a first end means and a second end means. The first end is detachably securable with respect to the first inwardly gripping slot of the first clip means and the second end is detachably securable with respect to the second inwardly gripping slot of the second clip means.

Preferably the first support member is secured to a structural wall surface and the second facing member extends parallel to and is spaced outwardly from this first support member. In this manner a block insulation member may be positioned therebetween.

Preferably the first facing member and the first mounting arm are integral with respect to one another and as such form a single part and similarly this second facing member and this second mounting arm are integral with respect to one another and thereby form a single part.

Preferably the first mounting arm includes a first shoulder therein and the first clip includes a first tab adjacent to the first outward gripping slot which is adapted to engage the first shoulder means to detachably secure the first mounting arm with respect to the first clip means.

In a similar fashion the second mounting arm should preferably include a second shoulder. Also the second clip means should include a second tab adjacent to the second outward gripping slot and is adapted to engage the second shoulder to detachably secure the second mounting arm with respect to the second clip.

The thermal insulation member should include a series of first and second apertures extending therealong and a first and second clip means should each include a first and second, respectively, finger means which are adapted to extend through the respective aperture means to thereby detachably secure the thermal insulation member with respect to the first and the second clip means.

Preferably additional fascia sections may be included which extend parallel or perpendicular but certainly outwardly with respect to the clip means to thereby hide the interlocking structure when used as exterior facing on walls.

It is an object of the present invention to provide a support structure for block-type insulation.

It is an object of the present invention to provide a wall panel-type support structure which is usable with many types of insulation including block polystyrene.

It is an object of the present invention to provide an insulation support structure having a thermally broken interlocking configuration to prevent heat transfer through the wall structure and around the insulation.

It is an object of the present invention to provide a thermally broken insulation support structure which is easy to install and easy to maintain.

It is an object of the present invention to provide a thermally broken insulation support structure which is relatively inexpensive.

It is an object of the present invention to provide a thermally broken insulation support structure which provides full and efficient insulation for wall configurations.

It is an object of the present invention to provide a thermally broken insulation support structure which can include an interlocking means around the complete exterior periphery thereof to provide a full building panel.

It is an object of the present invention to provide a thermally broken insulation support structure which includes a positive mechanical lock for interlocking in place.

It is an object of the present invention to provide a thermally broken insulation support structure which does not utilize blown-in polyurethane insulation which is unduly expensive and can give off toxic vapors.

It is an object of the present invention to provide a building panel which includes thermally broken insulation support structures which mechanically snaps into place.

It is an object of the present invention to provide a thermally broken insulation support structure which includes outwardly extending fascia to enhance the beauty thereof.

It is an object of the present invention to provide a thermally broken insulation support structure which can provide an external facing over garage doors or other pre-existing wall configurations.

It is an object of the present invention to provide a thermally broken insulation support structure including a thermal brake mechanically locking snap-in structure extending completely about the periphery of the snap-in wall panel.

It is an object of the present invention to provide a thermally broken insulation support structure for finishing and insulating an existing building.

It is an object of the present invention to provide a thermally broken insulation support structure which can include multiple mechanically interlocking configurations throughout the interior thereof to facilitate securement.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 2 is a side plan view of an embodiment of the invention shown in FIG. 1 with multiple interlocking positions;

FIG. 4 is a side plan view of an embodiment of the thermally broken insulation support structure of the present invention shown positioned adjacent to a wall structure.

DETAILED DESCRIPTION OF THE PREFERRED EMBODIMENT

Figure 1:
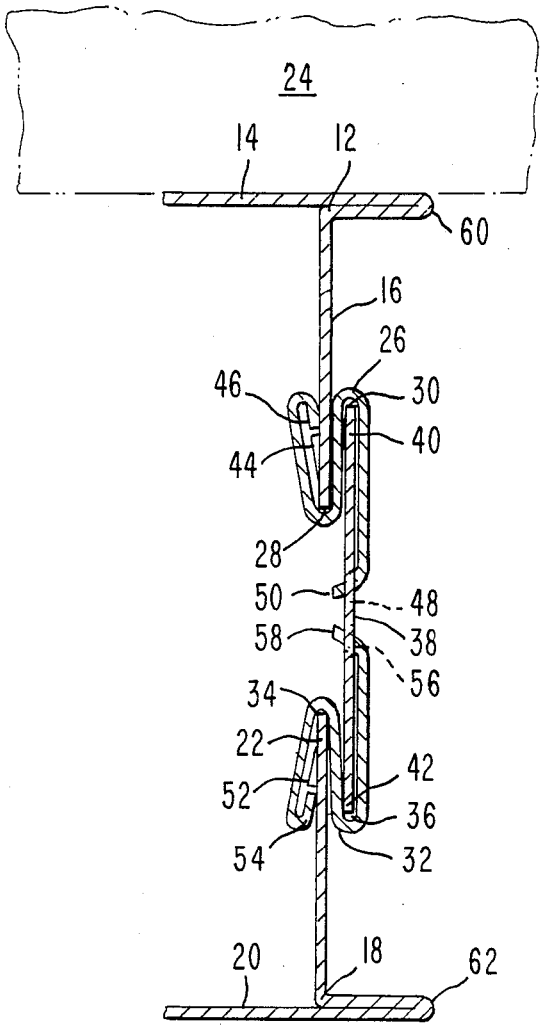
FIG. 1 is a side plan view of an embodiment of an interlocked thermally broken insulation support structure.
Figure 3:
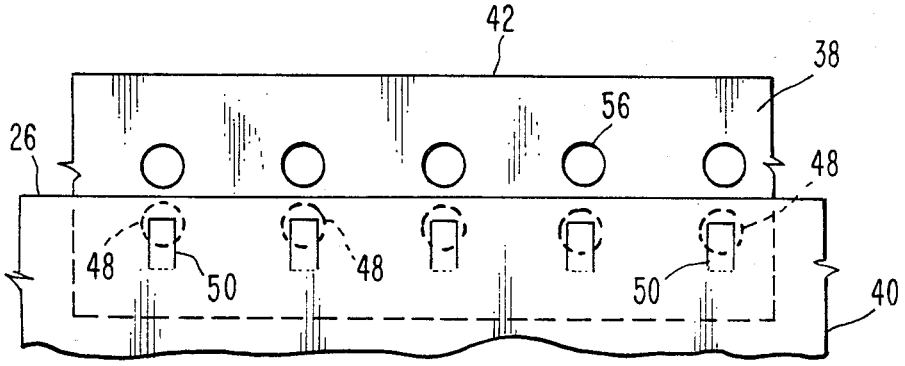
FIG. 3 is an end view of an embodiment of the thermally insulating member of the present invention shown with an embodiment of the first clip means secured thereto.

In the present invention a first support member 12 may include a first facing member 14 extending across the surface of a wall 24 or other building panel structure. The facing member 14 includes a first mounting arm 16 extending perpendicularly outward therefrom and thereby also being perpendicular with respect to the surface of the building panel. The structure of the first support member 12 can be one integral unit as shown in FIG. 1 thereby making the first facing member 14 and the first mounting arm 16 integral with respect to one another.

In a similar fashion a mirror image structure formed by a second support member 18 may extend parallel with respect to the first support member 12. In particular second support member 18 may include a second facing member 20 which is itself parallel to the first facing member 14 and a second mounting arm 22 which is coincident with respect to the first mounting arm 16 with the ends thereof spaced from one another. That is the first end means 40 of first mounting arm 16 and a second end means 42 of the second mounting arm 22 are spaced from one another so as to maintain thermal isolation with respect to one another. The structure of the second support member 18 can be one integral unit as shown in FIG. 1 thereby making the second facing member 20 and the second mounting arm 22 integral with respect to one another.

The present invention provides a means for mechanically locking these two ends with respect to one another while at the same time maintaining thermal isolation therebetween. In this manner block insulation 10 such as polystyrene can be positioned between the first facing member 14 and the second facing member 20 in such a fashion as to provide an insulated building panel structure which can stand alone or be added as a facing or a rear facing to an existing building structure.

To facilitate securement between the first end means 40 and the second end means 42 a first clip means 26 may be included. The first clip means 26 includes a first outward gripping slot 28 adapted to grasp the first end means 40 of first support member 12. Also first clip means 26 defines a first inward gripping slot 30 adapted to a grip a thermal isolation member 38. If slots 28 and 30 are immediately adjacent to one another the configuration of the clip means 26 may be S-shaped as shown in FIG. 1.

A second clip means 32 which defines a second outward gripping slot 34 and a second inward gripping slot 36 may also be included. Second outward gripping slot 34 is adapted to grip second end means 42 in a detachable mechanically gripping fashion. The second inward gripping slot 36 is adapted to grip the opposite end of a thermal isolation member 38. If slots 34 and 36 are immediately adjacent to one another the configuration of the clip means 32 may be S-shaped as shown in FIG. 1.

Thermal isolation member 38 thereby extends from first clip means 26 to second clip means 32 and in particular from a first inward gripping slot 30 to the second inward gripping slot 36. Preferably the thermal isolation member 38 can be rigid to facilitate structural strength.

This gripping configuration can extend about the entire periphery of a pre-defined building panel structure and the building panel itself can stand alone and thereby provide the building panel or can be added as an outside or inside facing member to increase insulation of a pre-existing wall structure.

With the securement means of the present invention extending about the entire periphery of a wall structure it is preferential that a mechanical interlocking feature be included. For this purpose a first shoulder means 44 may be positioned extending outwardly from the first mounting arm 16 of first support member 12. Also the first clip means 26 may include a first tab means 46 extending inwardly therefrom and adapted to interlock with the first shoulder means 44 to detachably secure the first clip means with respect to the first end means 40 of first mounting arm 16.

It is preferable that the thermal isolation member 38 define a plurality of first aperture means 46 extending therealong each adapted to receive therethrough a first finger means 50 which may be included in the first clip means 26 in a position adjacent to the first inward gripping slot 30. In this manner with the first finger means 50 extending through the first aperture means 48 a further secure and yet detachable mechanical interlocking means between the first clipping means and the thermal isolation member 38 will be achieved.

In a similar configuration the second mounting arm 22 will include a second shoulder means 52 extending outwardly therefrom. Also the second clip means 32 will include a second tab means 54 adjacent to the first outward gripping slot 28 in such a fashion that the shoulder means 52 and the tab means 54 will interlock causing the second clip means 32 to be detachably securable with respect to the second mounting arm 22. Furthermore a plurality of second aperture means 56 should preferably be defined by the thermal isolation member 38 and each of said second clip means 32 should include a second finger means 58 extending outwardly therefrom and adapted to extend through the second aperture means 56 interlocking therewith in a detachable fashion to facilitate securement of second clip means 32 with respect to the thermal isolation member 38.

To enhance the overall beauty of the configurations of the present design first fascia section 60 and second fascia second 62 extending perpendicularly outward from the end of the insulation support panel should be included in such a fashion as to hide the clipping configuration as shown best in FIGS. 2 and 4.

In operation the present invention will have the first facing member 14 secured by cement or nails or rivets to a surrounding wall structure with blocks of insulation then placed therein. With the clip which preferably surrounds the entire building panel then secured to the shoulder means 44 the outer panel with the clip configuration and thermal isolation member 38 can merely be snapped into place and thereby provide a self standing configuration or an added layer of insulation.

The present invention is particularly usable for block type insulations such as polystyrene. The dangers inherent with the use of blown-in insulation such as polyurethane are well known in the art. These blown-in insulations tend to give off poisonous vapors and require labor for installation. Also the polyurethane tends to be at least twice as expensive in material costs.

For this reason the present invention provides a system for placement of block type insulation wherein the inner and outer panels are merely snap-in configurations which greatly speeds installation time and greatly reduces installation costs.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A thermally broken insulation support structure, usable with any type of insulation and specifically usable with blocks of polystyrene or other block insulation material, which comprises:

(a) a first support member including a first facing member and a first mounting arm extending outwardly therefrom, said first mounting arm including a first shoulder means;

(b) a second support member including a second facing member and a second mounting arm extending outwardly therefrom toward said first mounting arm and being spatially disposed with respect thereto, said first facing member and said second facing member being spatially separated and approximately parallel with respect to one another, said second mounting arm including a second shoulder means;

(c) a first clip means defining a first outward gripping slot therein to grip and hold the outwardly extending end of said first mounting arm, said first clip means further defining a first inward gripping slot therein, said first clip means including a first tab means adjacent to said first outward gripping slot and adapted to engage said first shoulder means to detachably secure said first mounting arm with respect to said first clip means;

(d) a second clip means defining a second outward gripping slot therein to grip and hold the outwardly extending end of said second mounting arm, said second clip means further defining a second inward gripping slot therein, said second clip means including a second tab means adjacent to said second outward gripping slot and adapted to engage said second shoulder means to detachably secure said second mounting arm with respect to said second clip means; and (e) a thermal isolation member of thermally insulated material including a first end means and a second end means, said first end means being detachably securable within said first inward gripping slot of said first clip means and said second end means being detachably securable within said second inward gripping slot of said second clip means.

2. The thermally broken insulation support structure as defined in claim 1 wherein said first support member is secured to a structural wall surface and said second facing member extends parallel to and spaced outwardly therefrom and further including a block insulation means positioned therebetween.

3. The thermally broken insulation suppport structure as defined in claim 1 wherein said first mounting arm is at 90° with respect to said first facing member and said second mounting arm is at 90° with respect to said second facing member.

4. The thermally broken insulation support structure as defined in claim 1 wherein said first clip means and said second clip means are S-shaped.

5. The thermally broken insulation support structure as defined in claim 1 wherein said thermal insulation member is rigid.

6. The thermally broken insulation support structure as defined in claim 1 wherein said first facing member and said first mounting arm are integral with respect to one another.

7. The thermally broken insulation support structure as defined in claim 1 wherein said second facing member and said second mounting arm are integral with respect to one another.

8. The thermally broken insulation support structure as defined in claim 1 wherein said thermal insulation member includes a first aperture means extending therethrough and said first clip means includes a first finger means adapted to extend through said first aperture means to detachably secure said thermal insulation member with respect to said first clip means.

9. The thermally broken insulation support structure as defined in claim 1 wherein said thermal insulation member includes a second aperture means extending therethrough and said second clip means includes a second finger means adapted to extend through said second aperture means to detachably secure said thermal insulation member with respect to said second clip means.

10. The thermally broken insulation support structure as defined in claim 1 wherein said first support member includes a first fascia section extending outwardly from said first facing member perpendicular to said first mounting arm.

11. The thermally broken insulation support structure as defined in claim 1 wherein said second support member includes a second fascia section extending outwardly from said second facing member perpendicular to said second mounting arm.

12. A thermally broken insulation support structure, usable with any type of insulation and specifically usable with blocks of polystyrene or other block insulation material, which comprises:

(a) a first support member being secured to a structural wall surface including a first facing member and a first mounting arm integral with respect to one another extending perpendicularly outward therefrom, said first mounting arm including a first shoulder means;

(b) a second support member extending parallel to and spaced outwardly from said first support member and further including a block insulation means positioned therebetween, said second support member including a second facing member and a second mounting arm integral with respect to one another and extending perpendicularly outwardly therefrom toward said first mounting arm and being spatially disposed with respect thereto, said first facing member and said second facing member being spatially separated and approximately parallel with respect to one another, said second mounting arm including a second shoulder means;

(c) a first clip means being S-shaped and defining a first outward gripping slot therein to grip and hold the outwardly extending end of said first mounting arm, said first outward gripping slot including a first tab means adapted to interlock with said first shoulder means to detachably secure said clip means with respect to said first mounting arm, said first clip means further defining a first inward gripping slot therein and a first finger means adjacent thereto;

(d) a second clip means being S-shaped and defining a second outward gripping slot therein to grip and hold the outwardly extending end of said second mounting arm, said second outward gripping slot including a second tab means adapted to interlock with said second shouler means to detachably secure said clip means with respect to said second mounting arm, said second clip means further defining a second inward gripping slot therein and a second finger means adjacent thereto; and (e) a thermal isolation member of rigid thermally insulated material including a first end means and a second end means, said first end means being detachably securable within said first inward gripping slot of said first clip means and said second end means being detachably securable within said second inward gripping slot of said second clip means, said thermal insulation member defining a first aperture means extending therethrough adapted to receive said first finger means extending therethrough to detachably secure said thermal isolation member with respect to said first clip means, said thermal isolation member further including a second aperture means extending therethrough adapted to receive said second finger means to extend therethrough to detachably secure said thermal insulation member with respect to said second clip means.

13. The thermally broken insulation support structure as defined in claim 12 wherein said first support member includes a first fascia section extending outwardly from said first facing member perpendicular to said first mounting arm.

14. The thermally broken insulation support structure as defined in claim 12 wherein said second support member includes a second fascia section extending outwardly from said second facing member perpendicular to said second mounting arm.

* * * * *

UNITED STATES PATENT AND TRADEMARK OFFICE

CERTIFICATE OF CORRECTION

PATENT NO. : 4,548,015

DATED : Oct. 22, 1985

INVENTOR(S) : Harold Switzgable

It is certified that error appears in the above–identified patent and that said Letters Patent are hereby corrected as shown below:

Claim 12 (d), line 19, change "shouler" to -- shoulder --.

Signed and Sealed this

*Twenty-sixth* Day of *August 1986*

[SEAL]

*Attest:*

DONALD J. QUIGG

*Attesting Officer*

*Commissioner of Patents and Trademarks*